US007226348B1

(12) United States Patent
Chang

(10) Patent No.: US 7,226,348 B1
(45) Date of Patent: Jun. 5, 2007

(54) AIR SANDER GRINDER

(76) Inventor: Tse-Hua Chang, No. 86-15, Shencing Rd., Cingshuei Township, Taichung County (TW)

( * ) Notice: Subject to any disclaimer, the term of this patent is extended or adjusted under 35 U.S.C. 154(b) by 26 days.

(21) Appl. No.: 11/245,145

(22) Filed: Oct. 7, 2005

(51) Int. Cl.
*B24B 27/08* (2006.01)
*B24B 5/00* (2006.01)

(52) U.S. Cl. ..... 451/357; 451/295; 451/351

(58) Field of Classification Search ..... 451/357, 451/295, 351, 356, 344, 342, 359, 353
See application file for complete search history.

(56) References Cited

U.S. PATENT DOCUMENTS 4,854,085 A * 8/1989 Huber ..... 451/357
5,879,228 A * 3/1999 Sun ..... 451/357
6,257,970 B1 * 7/2001 Huber ..... 451/357
6,752,704 B1 * 6/2004 Lin ..... 451/295
6,752,705 B1 * 6/2004 Lin ..... 451/295
6,878,049 B2 * 4/2005 Heidelberger et al. ..... 451/364
2003/0143935 A1 * 7/2003 Huber ..... 451/357

* cited by examiner

*Primary Examiner*—Joseph J. Hail, III
*Assistant Examiner*—Alvin J Grant
(74) *Attorney, Agent, or Firm*—Egbert Law Offices

(57) ABSTRACT

An improved structure of an air sander grinder with air chamber mounting and eccentric mounting, and the cylinder air chamber mounting is placed inside the air sander grinder, and an air chamber is placed in the center of the air chamber mounting the sides of which has air inlet and air outlet openings the eccentric mounting includes a mandrel and an eccentric component, and the top of the mandrel has a drive section that is placed in the air chamber of the air chamber mounting, and the bottom of the mandrel has a linkage section connected with the eccentric component; the feature of the present invention is that the air chamber mounting is made by the inner metal ring with an outer plastic ring on the outside; the mandrel of the eccentric mounting is metal mandrel, and the eccentric component is a plastic eccentric component; the eccentric component is formed at the bottom of the metal mandrel.

7 Claims, 11 Drawing Sheets

AIR SANDER GRINDER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an air sander grinder, and more particularly to a device with a mounting that has an air chamber formed inside and eccentric mounting.

BACKGROUND OF THE INVENTION

Air sander grinder is a hand held grinder that is driven by air pressure. It has an eccentric mounting that vibrates by air pressure, and this vibration is sent to the grinding disc at the bottom, and an air chamber is placed on the upper part of tool with a set of movable leaves inside for the air pressure to form the driving effect. The present invention improves the structure of the mounting and eccentric mounting.

The conventional structure of the mounting is shown in FIGS. 1 and 2, the entire air chamber mounting 10 has an air chamber 11 installed therein. The air chamber has an air inlet 12 and air outlet 13 and is formed by processing a metal block. Except, the structure of this air chamber mounting has the existing issues described as follows:

1. Because the inside of the central air chamber 11 of the mounting must be cleared out entirely, it creates large amount of metal waste, besides increasing the processing time and not efficient and not cost effective, it also creates the environmental protection issue such as waste processing.

2. Moreover, the air outlets 12, 13 must be processed by lathing, milling and drilling, therefore, it generates waste, increases the processing time and cost as mentioned above, which does not meet the preferred practicability of the industry.

3. The current development for the air sander grinder is in the direction of lighter structure in convenience of long period operation for the users. Therefore, the metal structure of the conventional air chamber mounting mentioned above obviously has the heavy weight problems and creates more burdens when using it.

Secondly, the top section of the structure of the eccentric mounting of the air sander grinder is usually a mandrel, and the bottom section is an eccentric block, and the inside of the eccentric block must be machined to form a carrier slot for the axle of the grinding disc to place inside. One of the structures of the conventional eccentric mounting is to make the mandrel and eccentric block separately, then weld them together, however, because the welding part of the eccentric block is placed on top wall of the carrier slot, and the thickness of the wall is thin. Therefore, it fails to create sufficient welding strength, and to increase the thickness must increase the size and the weight of the entire structure, which is not good for developing a lighter product. The second structure of the conventional eccentric mounting 20 as shown in FIGS. 3 and 4 is to make the mandrel 21 and eccentric block 22 in one single metal block; except, this conventional structure has the existing issues found in the practical application.

1. Because the ratio of the mandrel 21 and eccentric block 22 of the eccentric mounting 20 is quite different, using one single metal material needs to be made based on the biggest outer diameter of the eccentric block 22, which largely increases the cost of the material. And the following process for making a mandrel and eccentric block must be formed by lathing and milling, not only generating large amounts of metal waste, but also showing the lack of efficiency during the forming process. The cost of processing machine is quite expensive; it does not meet the preferred practicability of the industry.

2. The current development for the air sander grinder is in the direction of lighter structure for the convenience of long period operation for the users. Therefore, the metal structure of the conventional mandrel 21 and eccentric block 22 is obviously heavy and is more burdensome while being used Thus, to overcome the aforementioned problems of the prior art, it would be an advancement if the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The features of the present invention that distinguishes it from the conventional air sander are:

1. It provides an air sander grinder with air chamber mounting structure inside that has an outer plastic ring 62 on the outside of the inner metal ring 61.

2. It provides an air sander grinder with eccentric mounting structure that is made of eccentric component 42 with mandrel 41.

3. The entire air chamber mounting 30 can be made into one piece by molding instrument, which can largely increase the production effect, and lower the amount of waste to the minimum, therefore, it can decrease the cost and meets the demand of environmental protection.

4. After the air chamber mounting 30 is formed, it respectively forms the air inlet and outlet 311, 312, which can eliminate the processing procedure, and largely reduce the production time, and reduce the defect rate and waste, and meet the preferred practicability of the industry.

5. Replace over half of the air chamber mounting that is made of metal with an outer plastic ring 62, and by so doing largely reduce the weight, and help making the air sander grinder lighter, which can help the user to operate it for long period of time, and the inner side where the movable impeller will be more durable because of the inner metal ring.

6. The eccentric component of the eccentric mounting 40 that has most of the area is replaced by the plastic that is lighter, therefore, the weight can be reduced largely, which is better for lightening the entire product, to make the user operate it more easily and better for operating for long period.

7. Because the eccentric component 42 of the eccentric mounting can be made into one piece on the bottom of the mandrel 41, therefore, this conventional eccentric mounting must be processed by lathing and milling, and the present invention can largely reduce the process of making the eccentric mounting to achieve the purposes of reducing the material and cost greatly, and increasing the mass production and reduce the amount of waste to the minimum.

The new effects of the present invention are:

By using the linkage section 412 of the mandrel 41 for reinforcement component and further reinforce the structure of eccentric component 42 to prevent it from curving and disfiguration.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
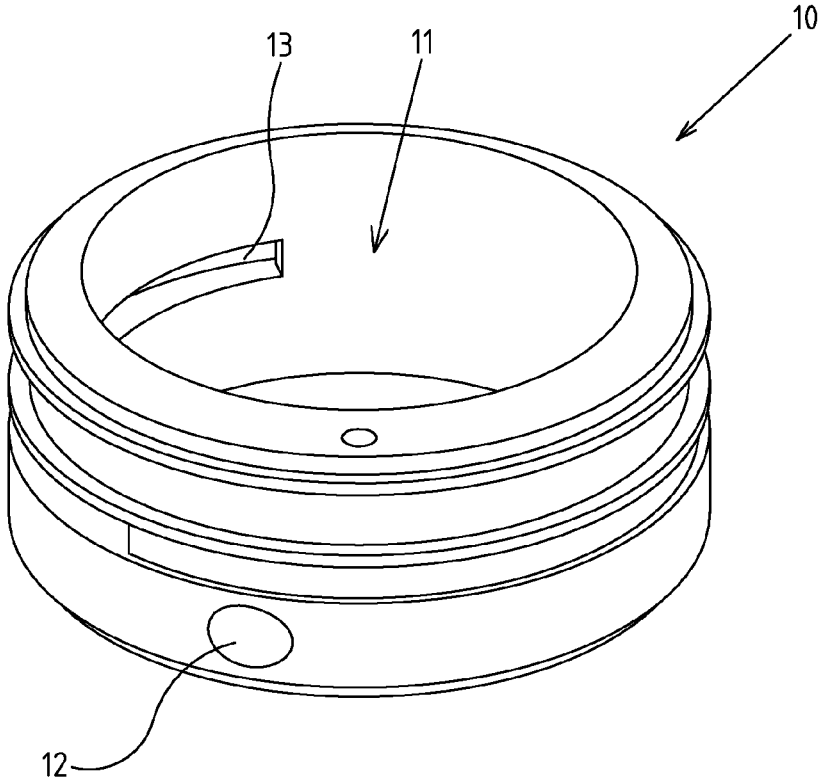
FIG.1 PRIOR ART
FIG. 1 shows a perspective view of the conventional air chamber mounting.
Figure 2:
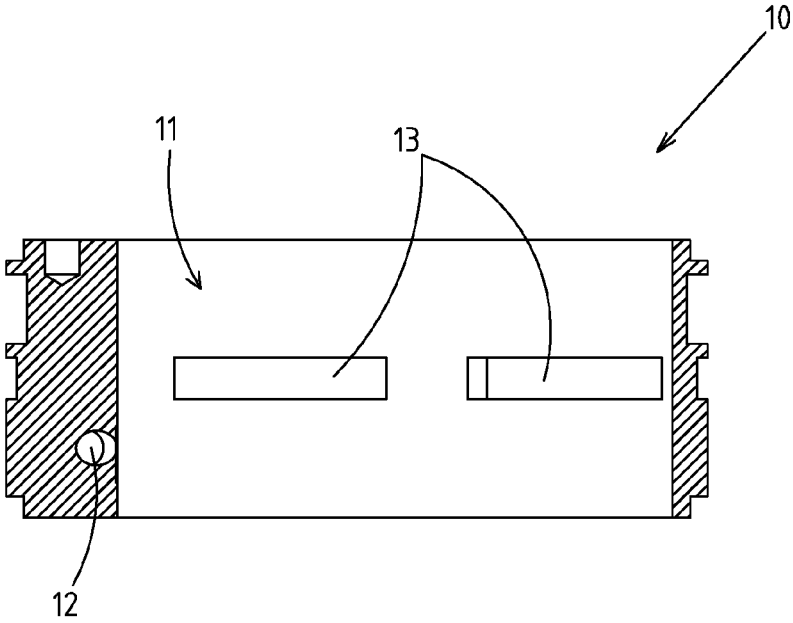
FIG.2 PRIOR ART
FIG. 2 shows the vertical sectional view of the conventional air chamber mounting.
Figure 3:
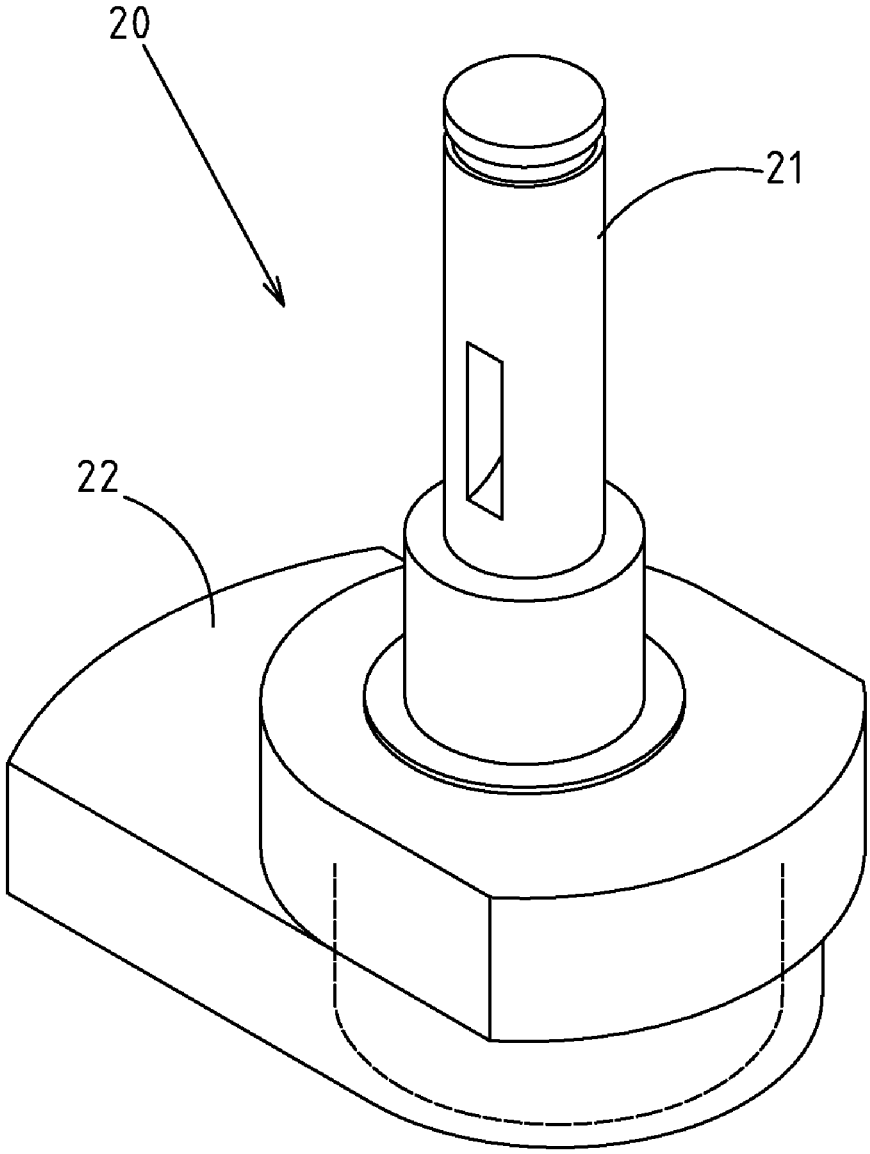
FIG.3 PRIOR ART
FIG. 3 shows a perspective view of the conventional eccentric mounting.
Figure 4:
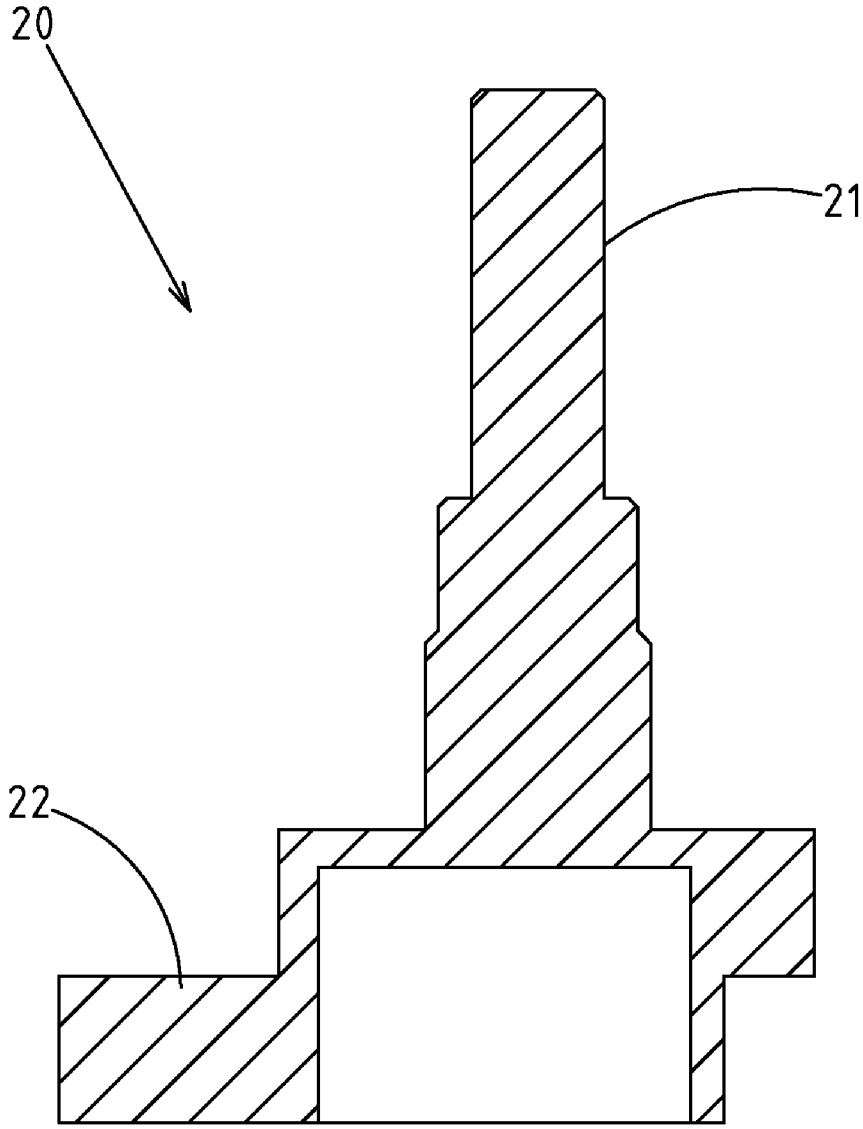
FIG.4 PRIOR ART
FIG. 4 shows the vertical sectional view of the conventional eccentric mounting.
Figure 5:
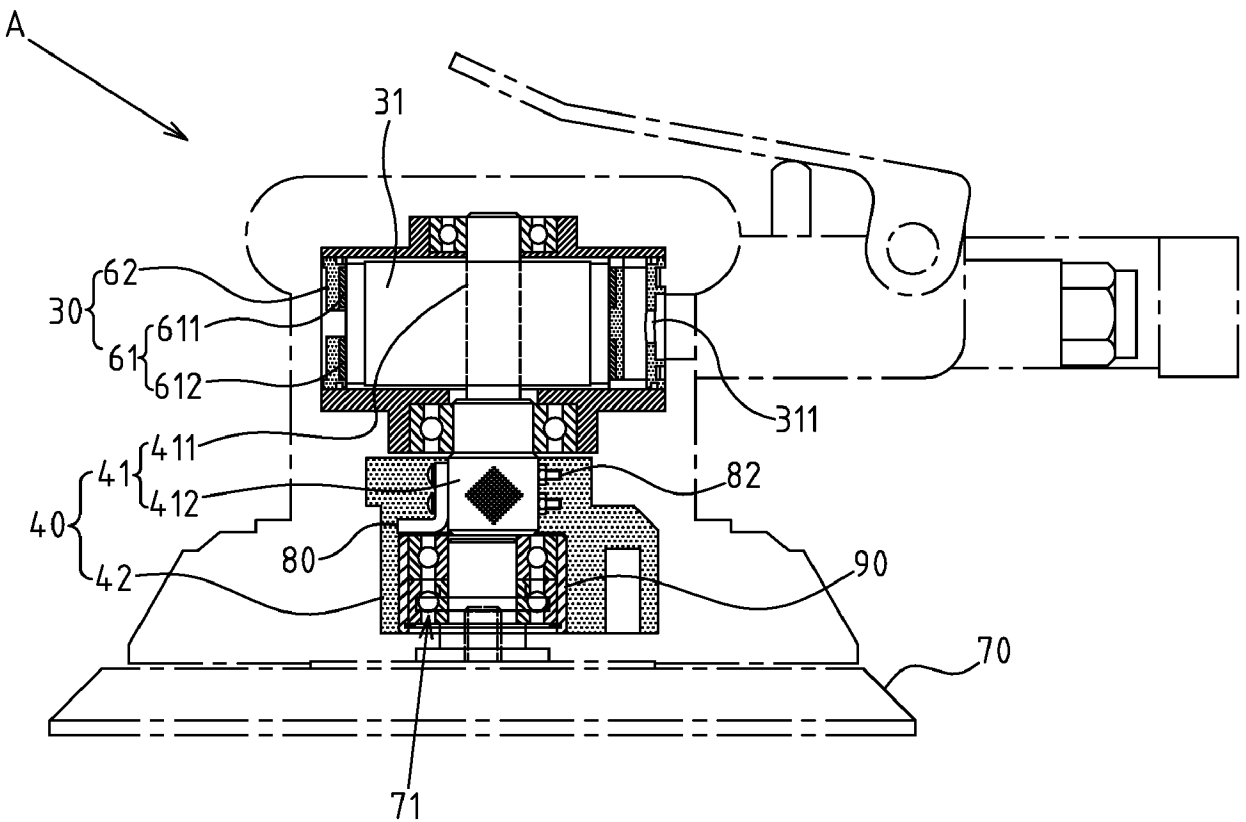
FIG. 5 shows a top plan view of the location of air chamber mounting and eccentric mounting that is placed in the air sander grinder.
Figure 6:
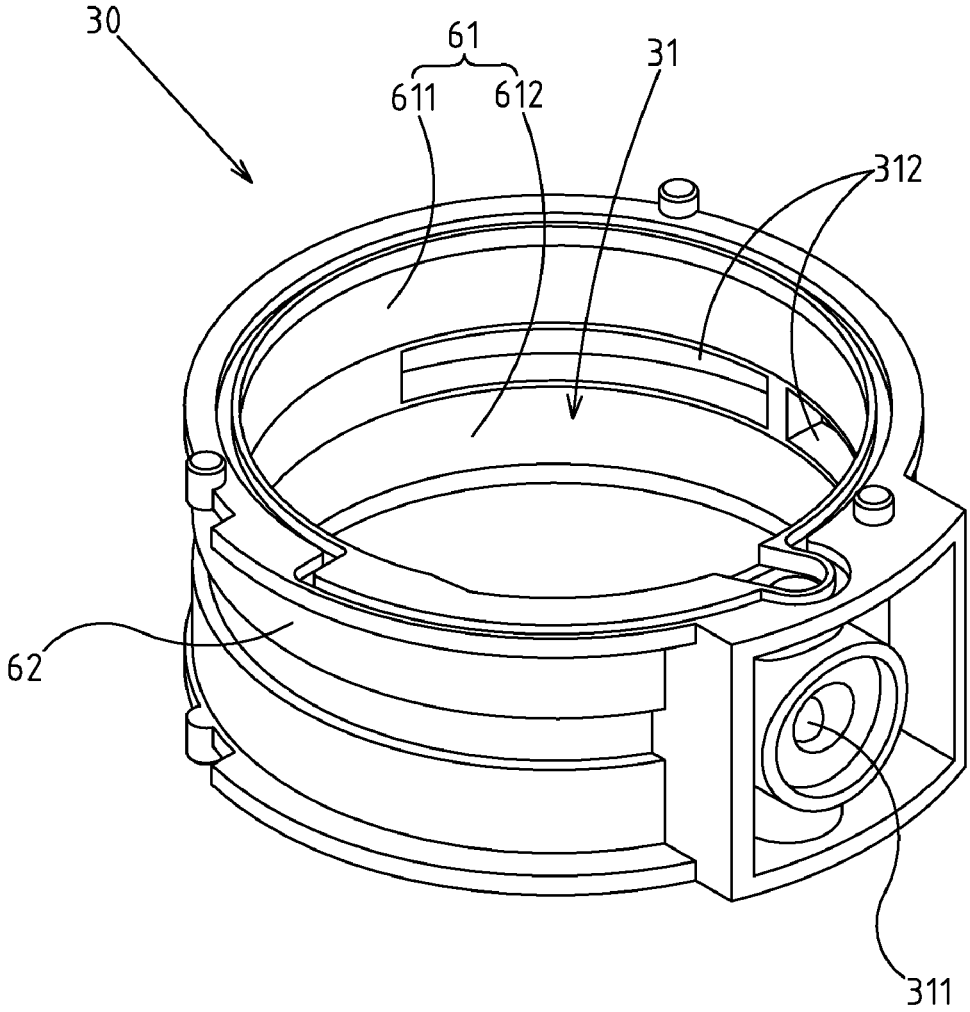
FIG. 6 shows a perspective view of the air chamber mounting of the present invention.
Figure 7:
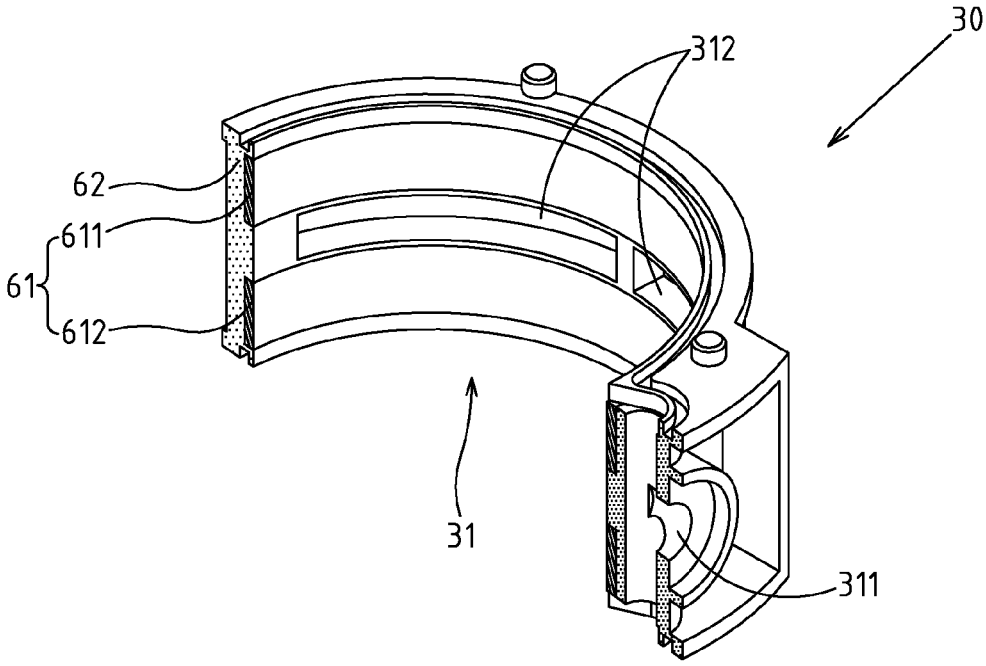
FIG. 7 shows a perspective view of the air chamber mounting of the present invention.
Figure 8:
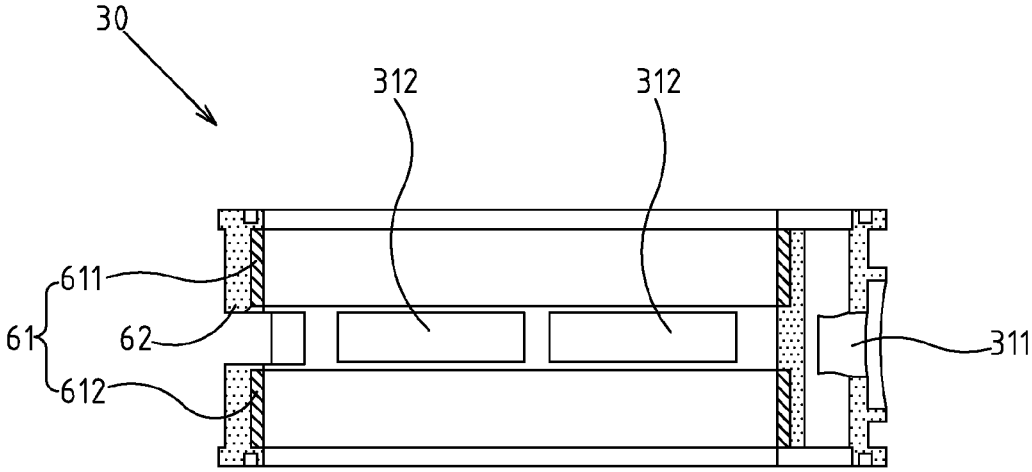
FIG. 8 shows the sectional view of the air chamber mounting of the present invention.
Figure 9:
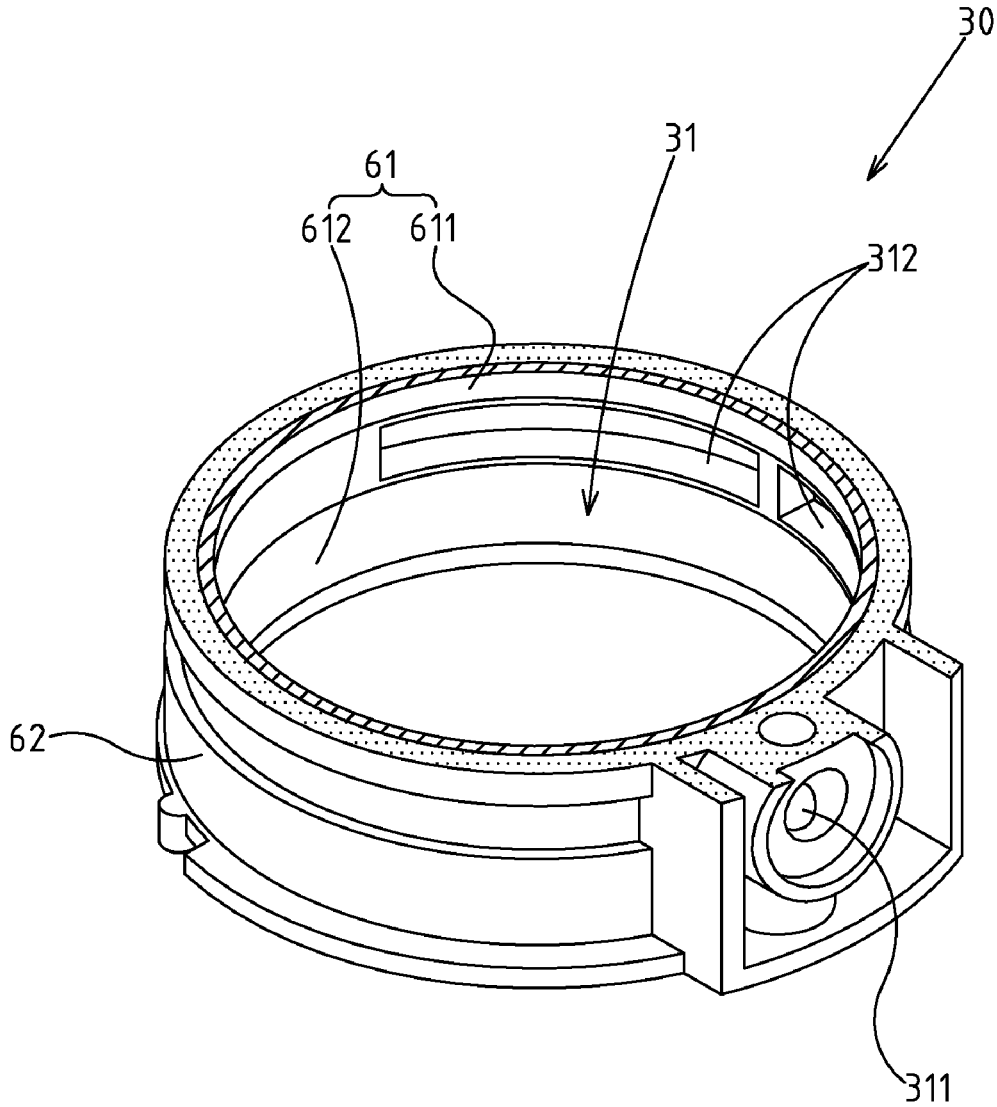
FIG. 9 shows a perspective view of the air chamber mounting of the present invention.
Figure 10:
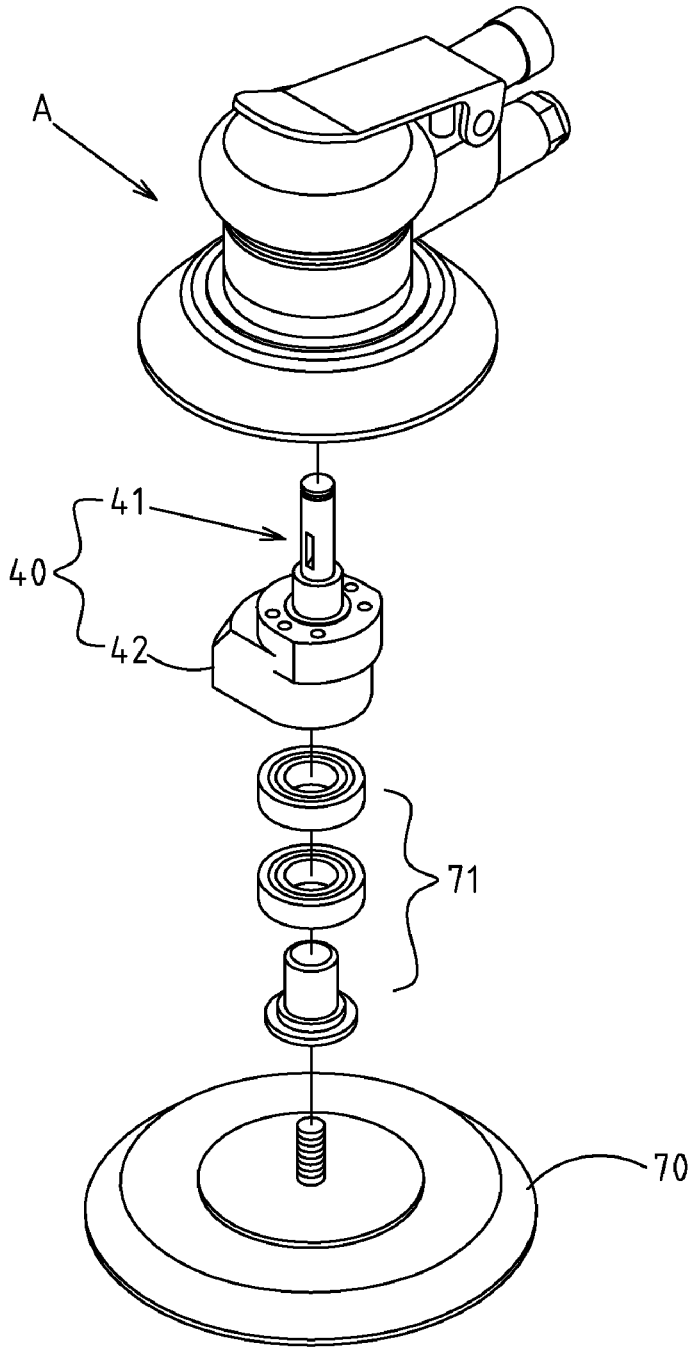
FIG. 10 shows an exploded perspective view of the relationship between the eccentric mounting and air sander grinder.
Figure 11:
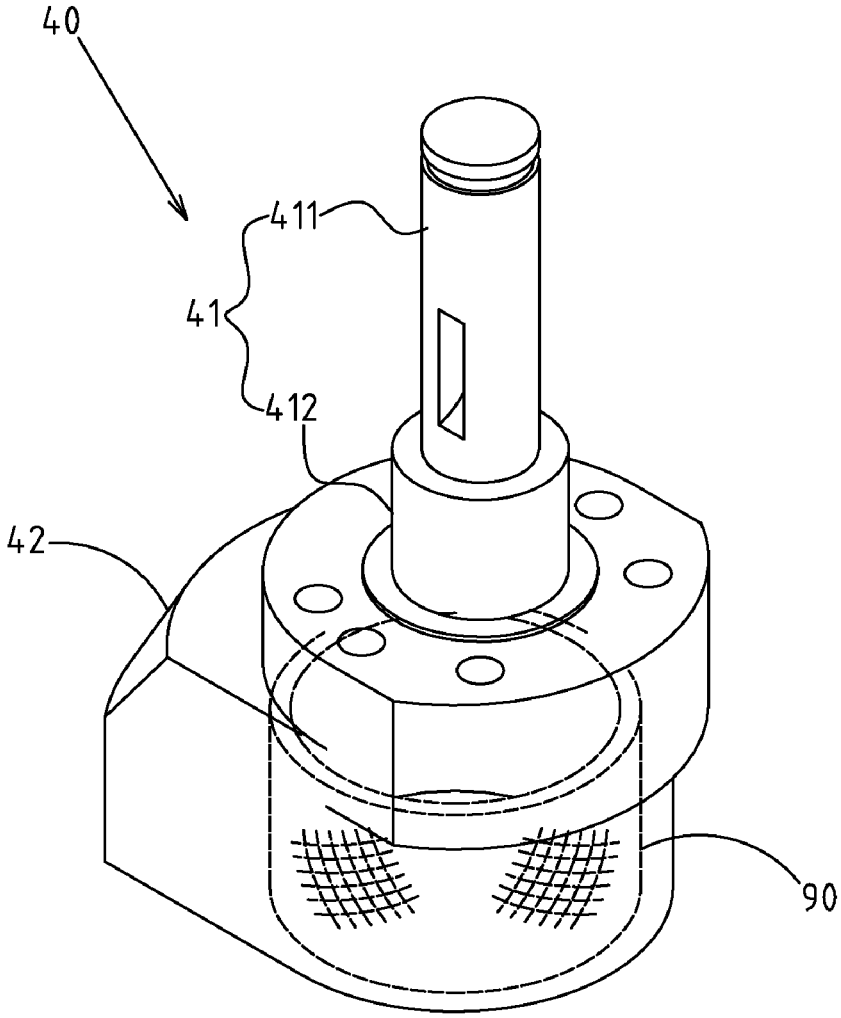
FIG. 11 shows a perspective view of the eccentric mounting of the present invention.

The features and the advantages of the present invention will be more readily understood upon a thoughtful deliberation of the following detailed description of a preferred embodiment of the present invention with reference to the accompanying drawings.

Structures shown in FIGS. 5~13 are improved structures of air chamber mounting and eccentric mounting for an air sander grinder. The air chamber mounting 30 is a cylinder that is placed inside the designated area in the air sander grinder A, and the an air chamber 31 formed inside in the center of the air chamber mounting 30, and on the side of the air chamber has air inlet 311 and air outlet 312 for the air pressure to come in and out. The eccentric mounting 40 mentioned includes a mandrel 41 on the top section and an eccentric component 42 on the bottom, and the top of the mandrel 41 has a drive section 411 that is placed in the air chamber 31 of the air chamber mounting 30 mentioned before, so that a set of movable impeller 50 is driven by directional registration (such as keying in method), and the bottom of the mandrel 41 has a linage section 412 that can be connected with the eccentric component 42 on the bottom. The movable impeller 50 may be driven by air pressure and further rotate the eccentric mounting and create the vibrating effect.

The improvement of the present invention includes an air chamber mounting 30 and the eccentric mounting 40.

First, as shown in FIGS. 6, 7, 8 and 9, the air chamber mounting 30 is made of an inner metal ring 61 that has an outer plastic ring 62 on the outside. The inner metal ring of this embodiment includes a first inner metal ring 611 and the second inner metal ring 612 that are separated on the top and bottom, and a section between the two inner metal rings 611 and 612 is set aside for air outlet 312, and the remaining area is formed with the outer plastic ring 62; the inner metal ring may also be a single ring, and processed to be air outlet 312 (It is not drawn in this embodiment).

Among them, the inner metal rings 611 and 612 and the outer plastic ring 62 may be made by the plastic molding instrument.

Moreover, the eccentric mounting 40 is shown in FIGS. 10, 11, 12, 13.

A mandrel 41 is a metal mandrel, and the linkage section 412 of the bottom of the metal mandrel 41 can be a cylinder type with patterned roller surface.

An eccentric component 42 is a plastic eccentric component that is made as mentioned above, and the eccentric component must use plastic material that is heat resistant in response to the high temperature when turning. The top of the eccentric component 42 has a preset depth that is connected to the linkage section 411 of the mandrel 41, and the bottom of the eccentric component 42 forms a inner groove 43 that is cylinder shape, which can be made for pivotal bearing 71 of the grinding disc 70 of the air sander grinder A to place inside.

Figure 12:
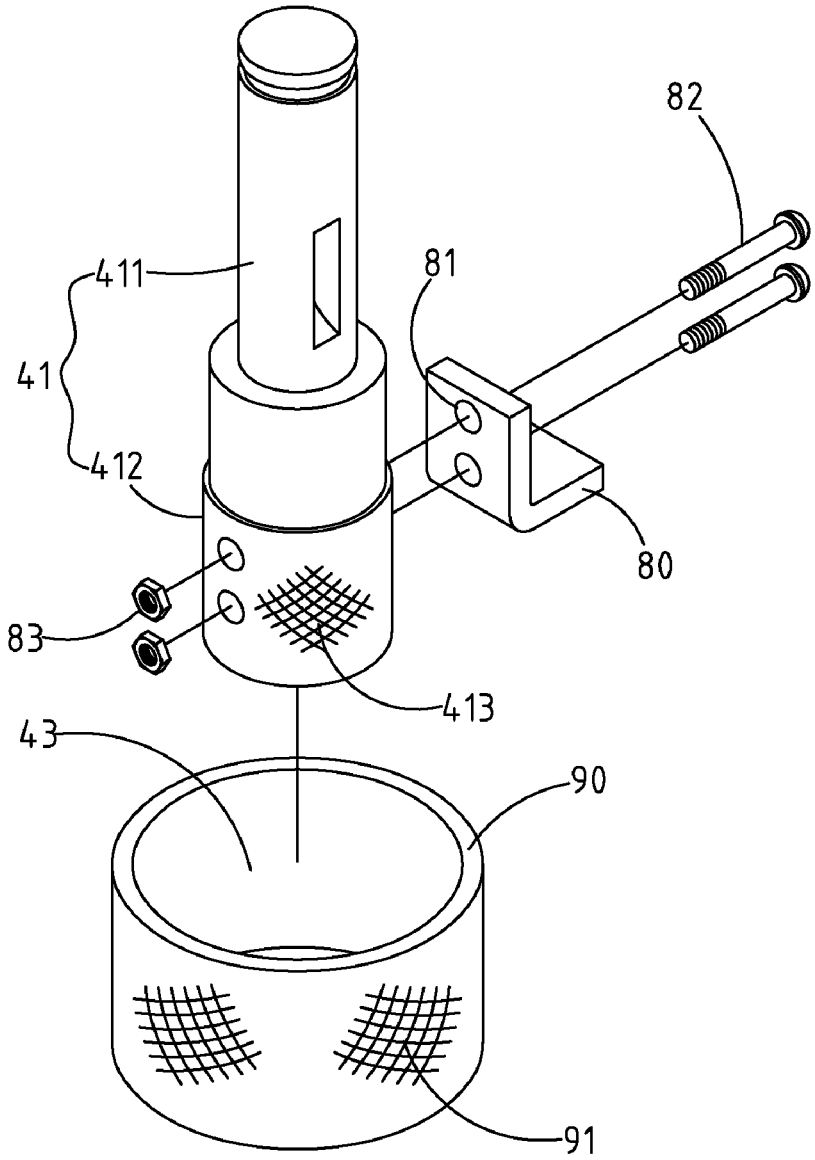
FIG. 12 shows an exploded perspective view of the metal of the eccentric mounting of the present invention.
Figure 13:
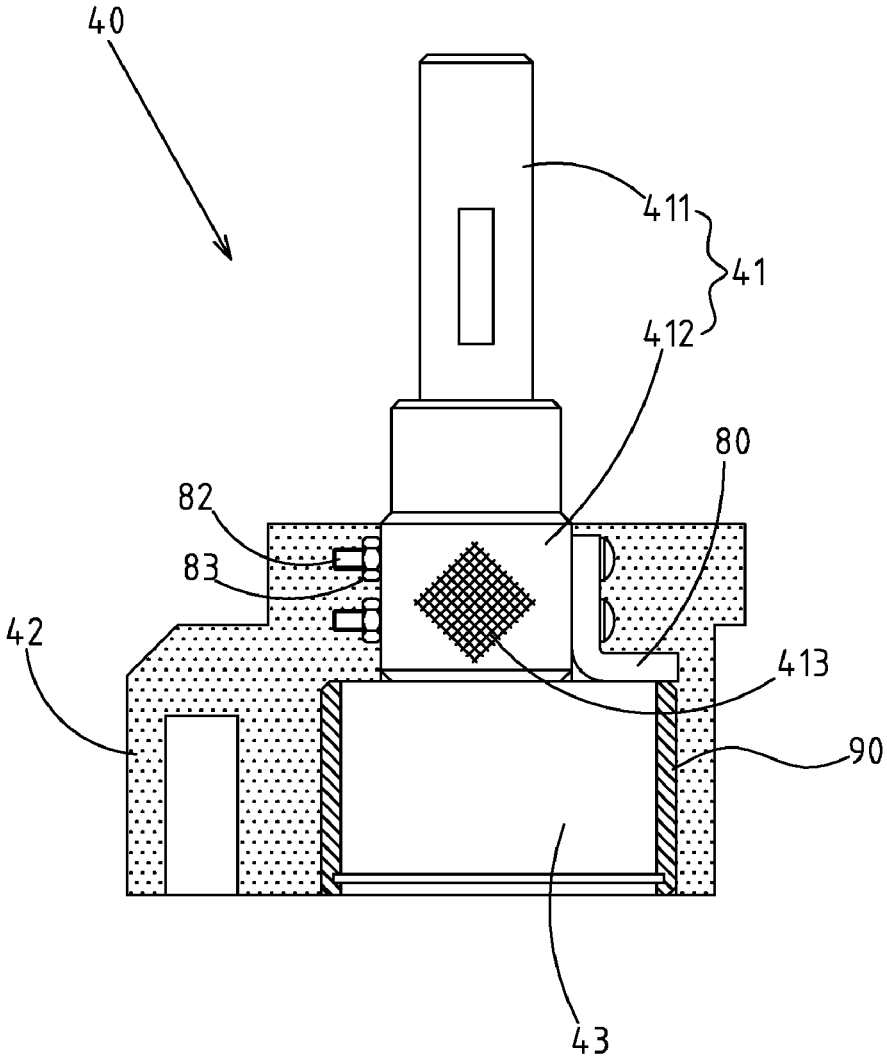
FIG. 13 shows a sectional view of the structure of the eccentric mounting of the present invention.

Among them, one side of the linkage section 412 of the bottom of the mandrel 41 can have a horizontal reinforcement component as shown in FIG. 12, and this reinforcement component can be a L-shaped metal plate 80, and the vertical side of the metal plate has a punch hole 81, so that the linage section 412 of the mandrel 41 also has a corresponding through hole 414 putting the bolt 82 through the punch hole and through hole and lock it with a nut 83 (as shown in FIG. 13). By adding the metal plate 80 primarily the eccentric component 42 is reinforced and its endurance is increased to prevent it from curving and disfiguration.

Among them, the bottom of the eccentric component 42 can form the inner groove 43 by a metal band 90. The outside of the metal band 90 can be made with patterned roller surface 91 to form a connection with the eccentric component 42.

Among them, the bottom of the mandrel 41 and L-shaped metal plate 80 lines up with the top of the groove 43, and when the pivotal bearing 71 of the grinding disc 70 is placed in it, the top of the pivotal bearing 71 can be put against the bottom of the mandrel 41 and the L-shaped metal plate 80 to obtain stronger and heat resistant support surface (as shown in FIG. 13).

I claim:

1. An air sander grinder structure comprising:

an air chamber mounting, having a cylinder placed inside an air sander grinder body and an air chamber formed in the center of the air chamber mounting, and on the side of the air chamber having an air inlet and air outlet; the air chamber mounting being connected to an outer plastic ring on an outside of an inner metal ring;

an eccentric mounting being comprised of a mandrel on a top section and an eccentric component on a bottom section, the top of the mandrel having a drive section placed in the air chamber of the air chamber mounting, the bottom of the mandrel having a linkage section connected to the eccentric component on the bottom; the mandrel being comprised of metal, the eccentric component being comprised of plastic; the plastic eccentric component being formed into one piece, the top of the eccentric component being connected to the linkage section of the mandrel, and an inner groove being formed in the bottom of the eccentric component for the pivotal bearing of the grinding disc of the air sander grinder to be placed inside.

2. The structure defined in claim 1, wherein said inner metal ring and the outer plastic ring of the air chamber mounting is formed into one piece by a plastic molding instrument.

3. The structure defined in claim 1, wherein said inner metal ring of the air chamber mounting is comprised of a first and second inner metal ring that is separated from top to bottom, an area between the two inner metal ring forming an air outlet, and the remaining area forming the cylinder shaped body by an outer plastic ring.

4. The structure defined in claim 1, wherein said linkage section of the bottom of the mandrel of the eccentric mounting is comprised of a cylinder shaped body having a patterned roller surface.

5. The structure defined in claim 1, wherein the linkage section of the bottom of the mandrel of the eccentric mounting is further comprised of a horizontal reinforcement component.

6. The structure defined in claim 1, wherein the bottom of the eccentric component of the eccentric mounting forms a groove by a metal band.

7. The structure defined in claim 4, wherein the outside of the metal band of the eccentric mounting has a patterned roller surface.

* * * * *